US005695407A

United States Patent [19]

Dunn, Jr. et al.

[11] Patent Number: 5,695,407

[45] Date of Patent: Dec. 9, 1997

[54] MOVABLE ROCKING-TYPE RECREATIONAL EQUIPMENT DEVICE

[75] Inventors: James O. Dunn, Jr.; Grant M. Strawcutter; Jonathan E. Brooks, all of Charlotte; Todd A. Coble, Stanfield, all of N.C.

[73] Assignee: Soft Play, L.L.C., Charlotte, N.C.

[21] Appl. No.: 688,033

[22] Filed: Jul. 26, 1996

[51] Int. Cl.[6] ..... A63G 31/14

[52] U.S. Cl. ..... 472/135; 472/95

[58] Field of Search ..... 472/95, 103, 104, 472/105, 106, 122, 113, 135; 482/35

[56] References Cited

U.S. PATENT DOCUMENTS

| | | | |
|---|---|---|---|
| 847,787 | 11/1907 | Kyle | 472/113 X |
| 2,705,144 | 3/1955 | Ridgway | 472/116 |
| 3,578,381 | 5/1971 | Young | 297/300 |
| 3,936,140 | 2/1976 | Ahrens | 272/54 |
| 4,379,550 | 4/1983 | Petersen | 272/52 |
| 4,995,603 | 2/1991 | Reed | 272/18 |
| 5,062,624 | 11/1991 | Reed | 272/1 |
| 5,205,748 | 4/1993 | Petersheim | 482/35 X |
| 5,226,864 | 7/1993 | Showers | 482/35 |
| 5,387,165 | 2/1995 | Warren | 482/35 |

OTHER PUBLICATIONS

Miracle Recreation Equipment Company 1995 Park & Playground Catalog, pp. 79–80.

Soft Play, L.L.C.'s 1995 "Value Series" brochure dated 1995.

*Primary Examiner*—Kien T. Nguyen

*Attorney, Agent, or Firm*—Polster, Lider, Woodruff, and Lucchesi

[57] ABSTRACT

A movable rocking-type recreational equipment device is disclosed. The device includes a tubular enclosure having opposite open ends for entry of an occupant and a support for suspending the enclosure above a floor or ground surface. The support and tubular enclosure are constructed and connected to one another to permit rocking movement of the tubular enclosure relative to the support through the movement of an occupant within the tubular enclosure. The tubular enclosure is resiliently supported relative to the support in order to level the tubular enclosure on the support following the conclusion of the rocking movement. The tubular enclosure may be connected to flexible tubes in a recreational play system environment to enable rocking movement of the tubular enclosure while remaining connected to the flexible tubes.

14 Claims, 3 Drawing Sheets

MOVABLE ROCKING-TYPE RECREATIONAL EQUIPMENT DEVICE

CROSS REFERENCE TO RELATED APPLICATIONS

This is a co-pending patent application of the following commonly assigned utility patent applications: Ser. No. 08/634,044, filed Jun. 13, 1996 entitled VERTICALLY MOVABLE RECREATIONAL EQUIPMENT DEVICE; Ser. No. 08/633,587, filed Apr. 17, 1996 entitled LATERALLY MOVABLE RECREATIONAL EQUIPMENT DEVICE still pending; Ser. No. 08/633,662, filed Apr. 17, 1996 entitled MOVABLE OCCUPANT DIRECTED RECREATIONAL EQUIPMENT DEVICE still pending; Ser. No. 08/633,462, filed Apr. 17, 1996, entitled MULTIDIRECTIONAL MOVABLE RECREATIONAL EQUIPMENT DEVICE still pending; and Design Patent Application Ser. No. 29/055,394, filed Jun. 5, 1996 entitled MOVING RECREATIONAL EQUIPMENT COMPONENT now U.S. Design Pat. No. D381,384.

BACKGROUND OF THE INVENTION

Children's outdoor playground or recreational equipment that facilitates movement is quite popular. In addition to swing sets, rotating or whirling devices and teeter-totters, children love to sit on spring mounted riders that have various animal and other shapes. Typically, such spring mounted riders have coil springs or leaf springs that extend between the ground and the rider. As a result, children can sit on the rider and create their own bouncing and rocking movements. Examples of such devices are shown in U.S. Pat. Nos. 3,578,381; 3,836,140; 4,379,550; and in the Miracle Recreation Equipment Company 1995 Park and Playground Catalog at pages 79–80.

Children's indoor playground or recreational equipment does not readily offer various moving type play devices. Space, along with safety, restricts the availability of various types of movable recreational equipment. This is also true of tubular play systems and enclosures through which children crawl or move, such as shown, for example, in Soft Play, L.L.C.'s 1995 "Value Series" brochure. Where an indoor recreational play system includes such tube and junction boxes or other enclosures through which children crawl or move, it would be desirable to provide movement of the junction box, enclosures or other elements. Although children enjoy being confined in a mirage or tubes and enclosures in such tubular play equipment, in order to create a more interesting environment, it has been discovered that it is possible to provide for movement of the enclosures or other elements, while enabling such elements to remain connected to generally flexible parts in the tubular play equipment.

There are some rotating and tilting enclosures which are separate, free standing devices, including for example, U.S. Pat. Nos. 4,995,603 and 5,062,624. However, when enclosures are part of a recreational play system that includes connected tubes and enclosures, it would be particularly desirable to provide for movement of the enclosures or other elements, while enabling same to remain connected to generally flexible tubes or other components in the tubular play equipment.

The present invention relates, in its broadest terms, to a movable rocking-type recreational equipment device, as compared to the vertically movable recreational equipment device, laterally movable recreational equipment device and multi-directional movable recreational equipment device of my aforementioned patent applications.

SUMMARY OF THE INVENTION

Accordingly, among the several objects and advantages of the present invention include:

The provision of a movable rocking-type recreational equipment device;

The provision of the aforementioned movable rocking-type recreational equipment device which allows for movement of the device while remaining connected to flexible tubular elements or other parts in a tubular play equipment system;

The provision of the aforementioned movable rocking-type recreational equipment device which provides for controlled fluid or resilient movement of the movable rocking-type recreational equipment device while being suspended relative to a support;

The provision of the aforementioned movable rocking-type recreational equipment device in which entry of an occupant provides controlled fluid or resilient movement relative to the support;

The provision of the aforementioned movable rocking-type recreational equipment device which provides smooth and safe movement in a controlled environment;

The provision of the aforementioned movable rocking-type recreational equipment device which also can provide leveling movement of the device relative to the support following the conclusion of the rocking movement; and, The provision of the aforementioned movable rocking-type recreational equipment device which can be quickly and economically manufactured; is easy to use and maintain; is made of a minimum number of parts; is safe in operation; and is otherwise well adapted for the purposes intended.

Briefly stated, the movable rocking-type recreational equipment device of the present invention includes a tubular enclosure having opposite open ends for entry of an occupant. A support suspends the tubular enclosure above a floor surface. The support and tubular enclosure are connected to one another to permit rocking movement of the tubular enclosure on the support through the movement of an occupant within the tubular enclosure. The device further includes means for leveling the tubular enclosure on the support following the conclusion of the rocking movement.

A complementary flexible tube has one end that may be connected to one open end of the tubular enclosure while a second end is connected to a complementary tubular element in a recreational play system environment.

The tubular enclosure is preferably an octagonally-shaped element. Specifically, the octagonally-shaped is preferably constructed with alternating smaller and larger interconnecting surfaces.

The tubular enclosure includes spaced elongated rods that extend in the same direction and are located on a lower end of the tubular enclosure for pivotally mounting same relative to a supporting rod on the support that extends generally transverse to the spaced elongated rods. Preferably, the spaced elongated rods are mounted to the smaller surfaces in the alternating smaller and larger interconnecting surfaces of the octagonally-shaped tubular enclosure.

The supporting rod of the support is connected to and rests on top of spaced supporting rod sections that are interconnected to each other by an interconnecting rod section that extends generally parallel to the supporting rod. All of the interconnecting rod sections and supporting rod sections being supported above a floor surface.

The means for leveling the tubular enclosure on the support following the conclusion of the rocking movement preferably includes generally opposed spaced coil springs. One end of each of the spaced coil springs engage one of the spaced supporting rods. A second end of each of the coil springs is attached to either a floor surface or to other fixed components of the support.

These and other objects and advantages of the present invention will become apparent from the description that follows.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

In the discussion that follows, it will be understood that the term "fluid" or "resilient" mounting is defined as a movable and/or changeable mounting structure, and includes resilient devices such as springs or other shock absorbing elements, as well as fluid (air or liquid) cylinders or other structure, which are able to move and change shape without separating under force or pressure. In the same sense, the term "fluid" or "resilient" movement is defined to include movable and/or changeable positions or movement along a predetermined path.

As distinct from the aforementioned copending patent applications in which movable recreational equipment devices have lateral or vertical or multi-directional movement, the movable rocking-type recreational equipment device of the present invention provides rocking-type movement, as will become apparent from the following description.

Figure 1:
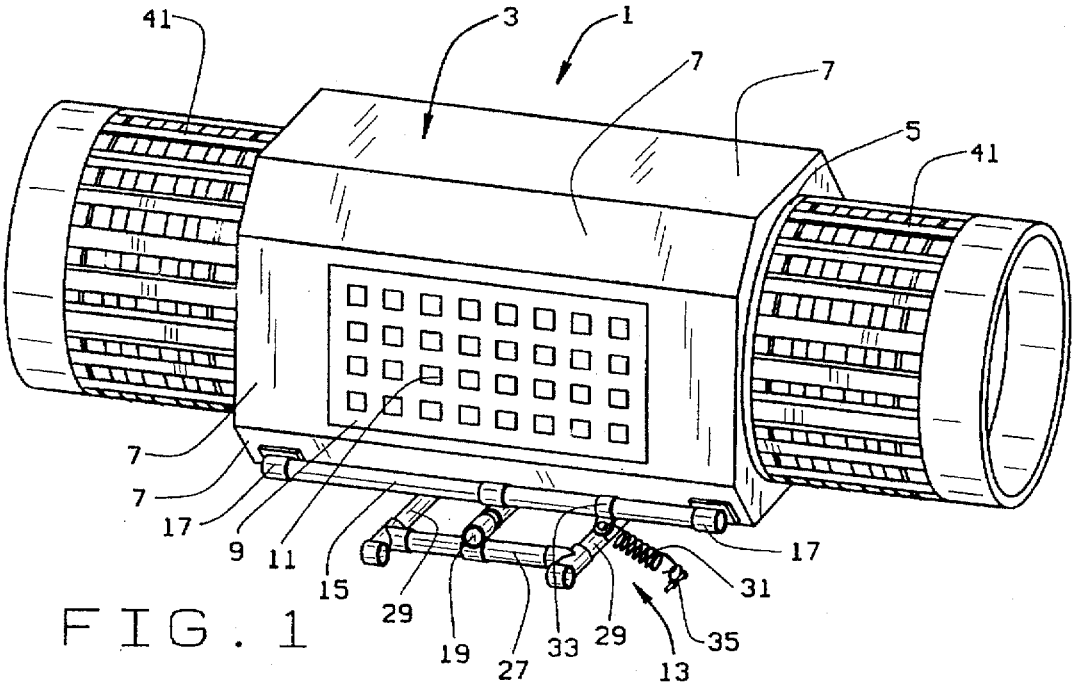
FIG. 1 is a perspective view of one embodiment of the movable locking-type recreational equipment device of the present invention.

FIGS. 1–6 illustrate two embodiments of the present invention; FIG. 1 illustrates one embodiment, while FIGS. 2–6 illustrate the second embodiment. The essential difference between the two embodiments is that in the FIG. 1 embodiment, one end of the generally opposed coil springs are mounted to a floor surface, while in the FIGS. 2–6 embodiment one end of the opposed coil springs is mounted to the fixed components of the support. Since the illustrated embodiments are nearly the same, the following discussion relates to both embodiments with specific differences distinguished as will become apparent below.

The movable rocking-type recreational equipment device 1 of the present invention includes a tubular enclosure 3 having opposite open ends 5, 5. The tubular enclosure 3 is preferably octagonally shaped with interconnecting surfaces 7. One or more windows 9 with a series of transparent window sections 11 may be provided in one or both of generally vertically directed interconnecting surfaces 7 on opposite sides of the octagonally shaped tubular enclosure 3. A support 13 suspends the tubular enclosure 3 above a floor surface. In order to provide the desired rocking movement of the tubular enclosure 3 on the support 13, the tubular enclosure 3 must be suspended by the support 13 an appreciable distance above a floor surface in order to prevent any contact with individuals below the rocking tubular enclosure 3. Alternatively, the device 1 may be positioned behind a netted barrier. In either case, safety must be kept in mind in the mounting of the tubular enclosure 3 relative to the support 13.

Figure 5:
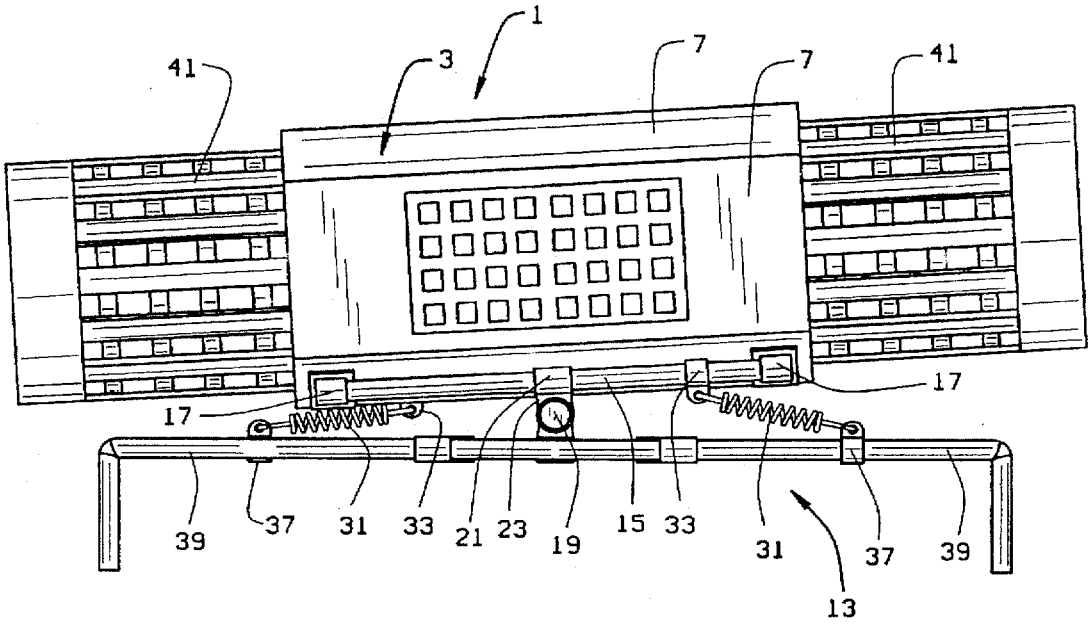
FIG. 5 is a front elevational view of the movable rocking-type recreational equipment device of the type shown in FIGS. 2–3 and illustrating the manner in which an occupant within the device is capable of rocking or tilting same to the left.
Figure 6:
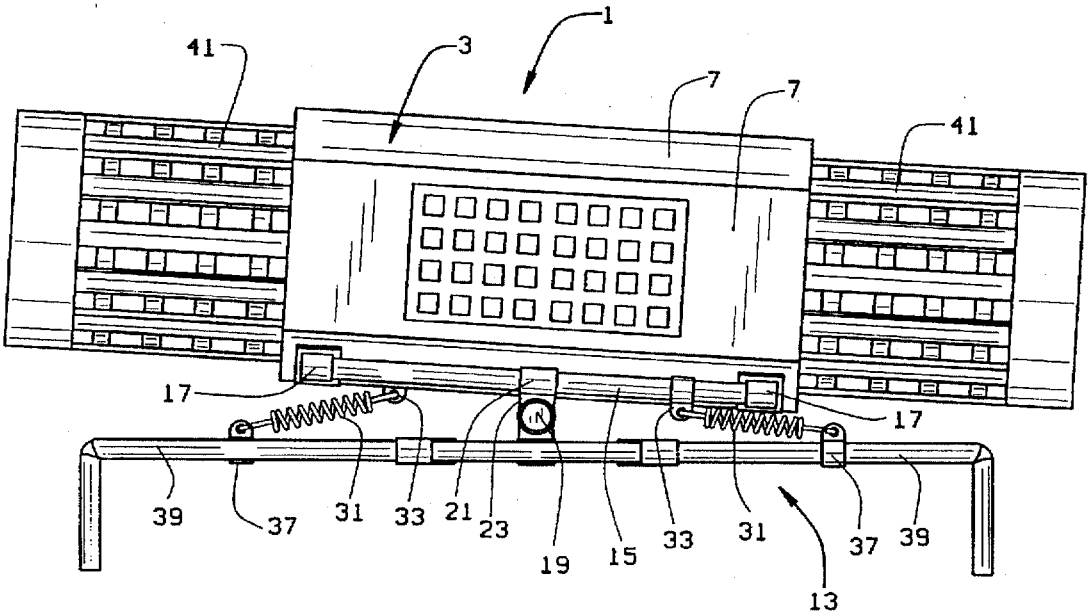
FIG. 6 is a front elevational view of the movable rocking-type recreational device of the type shown in FIGS. 2–5 and illustrating the manner in which an occupant within the device can rock or tilt the device to the right, Corresponding reference numerals will be used throughout the several figures of the drawings.

The tubular enclosure 3 and support 13 are connected to one another to permit rocking movement of the tubular enclosure 3 on the support 13, as shown in FIG. 5–6 of the drawings, through the movement of an occupant within the tubular enclosure. For this purpose, a pair of spaced elongated rods 15 extend in the same direction as and are located on a lower area of the tubular enclosure 3. As illustrated, each of the spaced elongated rods 15 are mounted to spaced surfaces 7 of the octagonally shaped tubular enclosure 3, along a lower area thereof. In this regard, each spaced elongated rod 15 includes fittings 17, 17 at opposite ends thereof to facilitate mounting of each spaced elongated rod 15 to one of the surfaces 7 through suitable fasteners (not shown).

Figure 3:
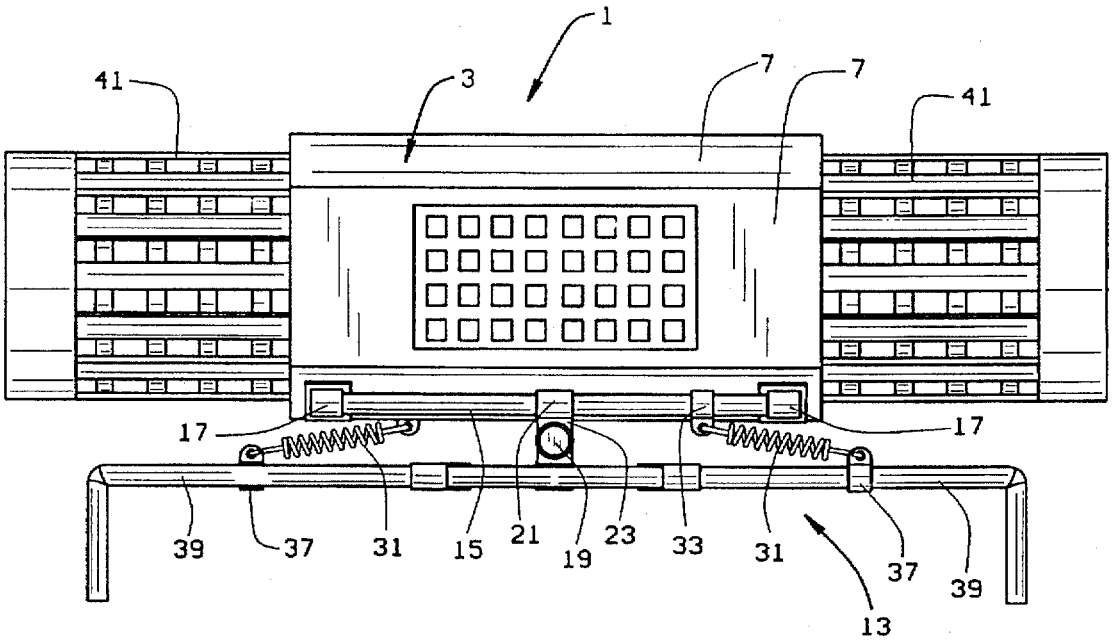
FIG. 3 is a front elevational view of the movable rocking-type recreational equipment device of the type shown in the FIG. 2 embodiment.
Figure 4:
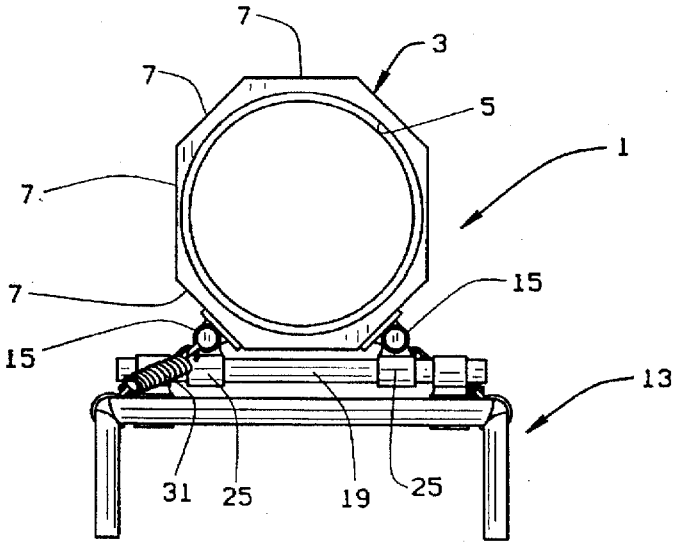
FIG. 4 is an end elevational view of the movable rocking-type recreational equipment device of the type shown in FIGS. 2–3.

As best seen in FIG. 4 of the drawings, the spaced elongated rods 15, 15 extend laterally outwardly from its associated surface 7 to facilitate rocking or pivotal mounting relative to a supporting rod 19 on the support 13 that extends generally transverse to the spaced elongated rods 15, 15. For the pivotal mounting, the fitting 21, centrally located on each of the spaced elongated rods 15, 15, is connected through a web or flange 23, as shown in FIGS. 3 and 5–6, to a tubular rotatable element 25 which is mounted on the transverse supporting rod 19 for pivotally mounting each of the spaced elongated rods 15, 15. Thus, when a child occupant enters the tubular enclosure 3, the tubular enclosure 3 moves downward until the child occupant crawls up past the center of the tube where it teeters or moves downward again. Such movement is provided by the tubular pivoting or rotatable element 25 mounted on the transverse supporting rod 19 adjacent to and interconnected to each of the spaced elongated supporting rods 15, 15 for the rocking movement of the tubular enclosure 3 on the support 13.

Figure 2:
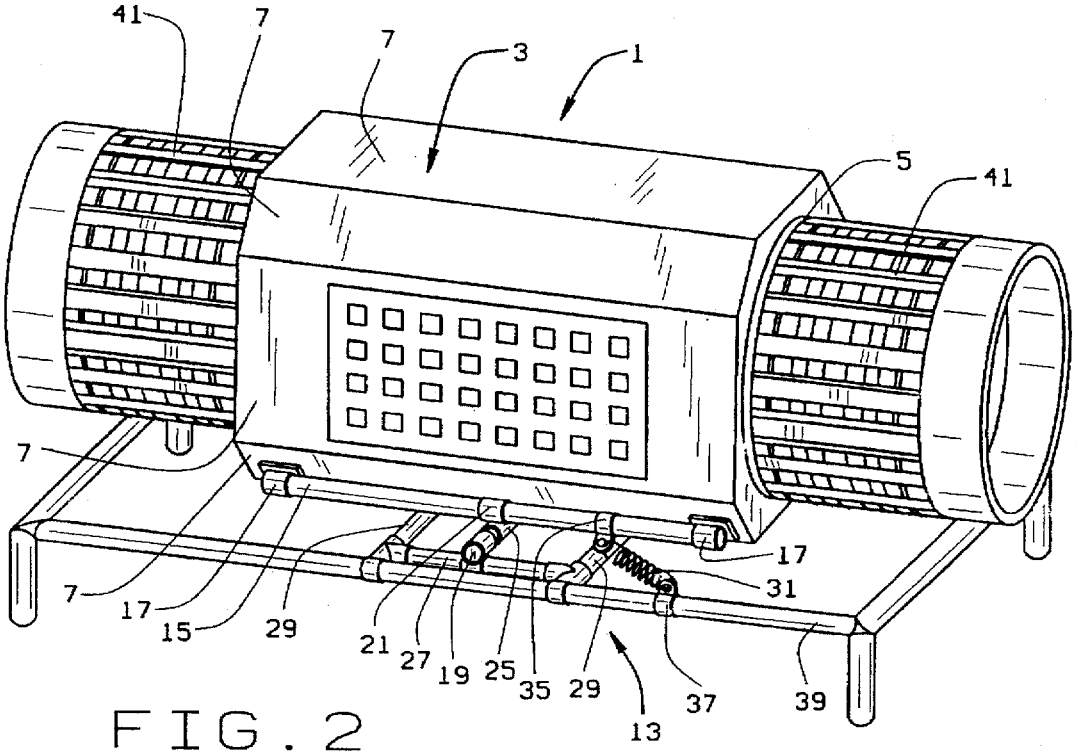
FIG. 2 is a perspective view of a second embodiment of the movable rocking-type recreational equipment device of the present invention.

The supporting rod 19 is connected to and rests on top of spaced supporting rod sections 27, 27 that are interconnected to each other by spaced interconnecting rod sections 29, 29 that extend generally parallel to the supporting rod 19, as best seen in FIGS. 1–2 of the drawings. All of the aforementioned supporting and interconnecting rod sections 27, 27 and 29, 29, respectively, are supported above a floor surface, in order to allow tilting or rocking movement of the enclosure 3 relative to the support 13.

When used for outdoor applications, the support 13 can suspend the tubular enclosure 3 a sufficient distance above a floor surface, as shown in FIG. 1, in order to permit the tilting or rocking movement of the tubular enclosure 3 relative to the support 13. However, in indoor applications, the tubular enclosure 3 must be suspended a safe distance above the heads of parents or other individuals or be located behind a netted barrier, as explained above.

Following the rocking movement of the tubular enclosure, leveling means are provided for returning the enclosure from the positions illustrated in FIGS. 5 and 6 to that in FIG. 3 where the tubular enclosure 3 is shown in the generally horizontal position. For this purpose, opposed spaced coil springs 31, 31 are provided. In the FIG. 1 embodiment, one end of the coil spring 31 is shown as being attached to one of the spaced elongated rods 15 through a clamp 33 or other suitable mechanism while the second end of the coil spring is shown as being attached to a ground support 35.

In the FIGS. 2–6 embodiment, each of the spaced opposed coil springs 31, 31 are attached at one end, through the clamp 33 or other suitable mechanism, to one of the spaced elongated rods 15 while a second end is attached through a clamp 37 or other suitable mechanism mounted to one of the fixed components 39 of the support 13.

The manner in which the spaced opposed coil springs 31, 31 are attached to the spaced rods 15, 15 is best illustrated in FIGS. 3–4 of the drawings. The spaced opposed coil springs 31, 31 act to level the tubular enclosure 3, following the rocking movement of the tubular enclosure.

Thus, as shown in FIG. 5 of the drawings, when a child occupant enters the tubular enclosure 3, the tubular enclosure 3 will move to the left in a downward direction, as a result of the rocking movement of the spaced rods 15, 15 on the transverse supporting rod 19. As a result, the coil spring 31 on the right hand side of the tubular enclosure 3, as shown in FIG. 5, will be stretched. As the child occupant moves past the center of the tubular enclosure 3, then the tubular enclosure 3 will move downwardly to the right as shown in FIG. 6 of the drawings, causing the spring 31 at the left hand side of FIG. 6 to be extended, as illustrated. Following the conclusion of the rocking movement, i.e., when a child occupant leaves the tubular enclosure 3, the spaced opposed coil springs 31, 31 will operate to level the tubular enclosure 3 from the positions illustrated in FIGS. 5 and 6 of the drawings to that shown in FIG. 3 where it is generally horizontally directed.

Suitable flexible tubes 41, made from webbing material, for example, may be mounted within the opposite open ends 5 of the tubular enclosure 3. A second end of the flexible tubes 41 may be connected to a complementary tubular element (not shown) in a recreational play system environment, such as shown in the aforementioned copending patent applications. Such interconnected tubular elements are typically used in an indoor recreational play system environment, although they can also be used in outdoor applications, if desired. The flexible tubes 41 allow a tubular enclosure 3 to move in its rocking or tilting path, without disturbing the other complementary tubular elements in the recreational play system environment.

From the foregoing, it will now be appreciated that the movable rocking-type recreational equipment device of the present invention permits rocking movement of the tubular enclosure relative to the support through the movement of an occupant within the tubular enclosure. However, following the conclusion of the rocking movement, spaced opposed coil springs level the tubular enclosure on the support for subsequent rocking or tilting movement of the tubular enclosure relative to the support.

As various changes could be made in the above constructions without departing from the scope of the invention, it is intended that all matter contained in the above description or shown in the accompanying drawings shall be interpreted as illustrative and not in a limiting sense.

What is claimed is:

1. A movable recreational equipment device including:

a tubular enclosure having opposite open ends;

a support for suspending the tubular enclosure above a floor surface;

the support and tubular enclosure being connected to one another to permit rocking movement of the tubular enclosure on the support through the movement of an occupant within the tubular enclosure;

means for leveling the tubular enclosure on the support following the conclusion of the rocking movement; and complementary flexible tube having one end connected to one open end of the tubular enclosure.

2. The device as defined in claim 1 in which a complementary tubular element is connected to a second end of each of the flexible tubes to provide a recreational play system environment.

3. The device as defined in claim 1 in which the tubular enclosure is an octagonal shaped element.

4. The device as defined in claim 1 in which the tubular enclosure includes spaced elongated rods extending in the same direction and located on a lower area of the tubular enclosure for pivotal mounting relative to a supporting rod on the support that extends generally transverse to the spaced elongated rods.

5. The device as defined in claim 4 in which the means for leveling the tubular enclosure includes generally opposed spaced coil springs.

6. The device as defined in claim 5 in Which one end of each of the spaced coil springs engage one of the spaced elongated rods.

7. The device as defined in claim 6 in which a second end of each of the coil springs is attached to a floor surface.

8. The device as defined in claim 7 in which a second end of each of the coil springs is attached to other fixed components of the support.

9. A movable recreational equipment device, including:

a tubular enclosure having opposite open ends;

a support for suspending the tubular enclosure above a floor surface;

spaced elongated rods extending in the same direction and projecting from a lower area of the tubular enclosure;

the support including a supporting rod extending generally transversely to and positioned below the spaced elongated rods;

the spaced elongated rods being pivotally mounted to the supporting rod to facilitate rocking movement of the tubular enclosure on the support through the movement of an occupant within the tubular enclosure; and a coil spring connected at one end to one elongated rod on each side of the tubular enclosure and extending in generally opposite direction to each other, a second end of each coil spring being connected to a fixed surface, whereby the coil springs level the tubular enclosure following the conclusion of the rocking movement.

10. The device as defined in claim 9 in which the fixed surface is a floor surface.

11. The device as defined in claim 9 in which the fixed surface is part of a fixed component of the support.

12. The device as defined in claim 9 in which the tubular enclosure is octagonally shaped with eight surfaces, and each of the spaced elongated rods being mounted to one of the interconnected surfaces of the tubular enclosure.

13. The device as defined in claim 12 in which each one of the spaced elongated rods are mounted to interconnected surfaces along a lower area of the octagonally shaped tubular enclosure.

14. The device as defined in claim 9 in which the supporting rod is connected to and rests on top of spaced supporting rod sections that are interconnected to each other by an interconnecting rod section that extends generally parallel to the supporting rod, the interconnecting rod sections and supporting rod sections being supported above a floor surface.

* * * * *